US011118309B2

(12) United States Patent
Schroeder

(10) Patent No.: US 11,118,309 B2
(45) Date of Patent: Sep. 14, 2021

(54) DEVICE, MACHINE AND METHOD FOR DEWATERING A WET-LAID FIBROUS WEB

(71) Applicant: VOITH PATENT GMBH, Heidenheim (DE)

(72) Inventor: Ralf Schroeder, Juelich (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/531,321

(22) Filed: Aug. 5, 2019

(65) Prior Publication Data

US 2020/0040527 A1 Feb. 6, 2020

(30) Foreign Application Priority Data

Aug. 3, 2018 (DE) ..... 102018118884.6

(51) Int. Cl.
*D21F 3/04* (2006.01)
*D21F 3/02* (2006.01)

(52) U.S. Cl.
CPC ..... *D21F 3/04* (2013.01); *D21F 3/0272* (2013.01)

(58) Field of Classification Search
CPC . D21F 3/04; D21F 3/0272; D21F 7/00; D21F 1/483
See application file for complete search history.

(56) References Cited

U.S. PATENT DOCUMENTS

| | | | | |
|---|---|---|---|---|
| 5,076,894 | A | 12/1991 | Simmons et al. | |
| 5,858,175 | A | 1/1999 | Feiler | |
| 6,752,909 | B2 * | 6/2004 | Halmschlager | D21F 1/483 162/351 |
| 6,821,389 | B2 | 11/2004 | Halmschlager et al. | |
| 2003/0183357 | A1 * | 10/2003 | Sherril | D21F 1/00 162/352 |

FOREIGN PATENT DOCUMENTS

| | | | |
|---|---|---|---|
| DE | 2053780 | A1 | 3/1972 |
| DE | 29615823 | U1 | 10/1996 |
| DE | 10163575 | A1 | 7/2003 |
| DE | 102016120649 | A1 | 5/2018 |
| EP | 1975314 | A2 | 10/2008 |
| GB | 1326266 | A | 8/1973 |

* cited by examiner

*Primary Examiner* — Eric Hug
*Assistant Examiner* — Elisa H Vera
(74) *Attorney, Agent, or Firm* — Laurence A. Greenberg; Werner H. Stemer; Ralph E. Locher

(57) ABSTRACT

A device dewaters a wet-laid non-woven web formed from a fibrous suspension. The device has a multiplicity of dewatering strips which are disposed so as to be mutually spaced apart. Mutually neighboring dewatering strips conjointly delimit a dewatering gap for discharging liquid from the fibrous suspensions. The device further has at least three format slides which along the longitudinal direction of the respective dewatering gap are disposed or disposable so as to be distributed relative to one another and which partially obscure the dewatering gap in such a manner that any discharging of the liquid by way of the obscured part of the dewatering gap is prevented.

17 Claims, 2 Drawing Sheets

DEVICE, MACHINE AND METHOD FOR DEWATERING A WET-LAID FIBROUS WEB

CROSS-REFERENCE TO RELATED APPLICATION

This application claims the priority, under 35 U.S.C. § 119, of German application DE 10 2018 118 884.6, filed Aug. 3, 2018; the prior application is herewith incorporated by reference in its entirety.

BACKGROUND OF THE INVENTION

Field of the Invention

The invention relates to a device for producing a wet-laid nonwoven web. The invention furthermore relates to the use of such a device and to a machine containing such a device.

Various methods of non-woven forming are known from the prior art. The non-woven web is usually carried out by a wet-laying method onto an inclined screen former by way of a very low consistency of the fibrous suspension, and specifically in particular by way of a solids content of 0.01 to 0.1% by weight in terms of 100% by weight of the non-woven obtained.

The production of wet-laid non-woven webs of such type on machines known from the prior art is unsatisfactory in terms of the width of the non-woven web not being able to be set so as to be small in an arbitrary manner, on the one hand. On the other hand, the edges cannot be readily cut using an edge trimmer, above all when non-woven webs are produced from long fibers. This is because the long fibers catch on the edge trimmer which is embodied as a knife, for example. This thus leads to untidy edges. The latter cause tears when transferred to the following sections of the machine, such as to the bonding section or the drying section. The tears lead to unintended downtimes of the machine.

Moreover, further resources such as compressed air or spray water are required for edge trimmers, the resources having had to be kept ready and fed to the edge trimmer. Moreover, hydraulic turbulences of the fibrous suspension about the edge trimmers resulted in the case of the known edge trimmers or format shields. This led to an unintended deviation in terms of the area weight on the edges of the finished non-woven fabric.

SUMMARY OF THE INVENTION

The present invention relates to the generic subject matter mentioned at the outset.

The present invention is based on the object of specifying a device for dewatering a wet-laid non-woven web from a fibrous suspension by which device the afore-mentioned problems can be eliminated in a manner that is as simple and reliable as possible. In particular, a device on which the width of the non-woven web(s) to be produced can be set in a simpler manner and which delivers tidy edges of the non-woven web(s) is to be specified. The invention furthermore relates to the use of such a device and to a machine containing such a device.

The object is achieved as claimed in the independent claims. Particularly preferred and advantageous embodiments of the invention are set forth in the dependent claims.

The inventor has realized that the width of the non-woven web to be produced can also be set during the intended operation of the machine in which the non-woven web is produced by providing in each case at least three format slides in the same dewatering gap. Two or more (particularly narrow) non-woven webs can thus be produced beside one another simultaneously on the device for dewatering, for example. Simultaneously means that a plurality of non-woven webs can be produced on the same device, thus from the same fibrous suspension that exits the headbox. It could also be said that the displaceable format slides thus act as dividers for the fibrous suspension that exits the headbox. In other words, an arbitrary format width which is equal to or smaller than the format width of the former can be set by way of the disposal of at least two format slides per axial end of the dewatering strip. A tidy separation of the edges of the one or the plurality of simultaneously producible non-woven webs can thus be achieved by way of the solution according to the invention, without edge trimmers having to be used.

A fibrous suspension in the context of the invention is understood to be a mixture from a liquid, such as water, and fibers.

A non-woven web in the context of the invention is understood to be a cross-laid or random-laid structure of fibers of limited length, for example continuous fibers (filaments) produced from a fibrous suspension, or from cut yarns. The non-woven web herein initially has a minor strength in such a manner that the non-woven web is not capable of being self-supporting. In the context of the present invention this is a wet-laid non-woven fabric, thus a hydraulically (or hydro-dynamically) formed non-woven fabric. The non-woven fabric can finally be solidified so as to produce the non-woven fabric. Such a non-woven fabric is considered finally solidified when the non-woven fabric on account of the solidification substantially has a high strength in such a manner that the non-woven fabric is suitable for the intended application, for example for the further processing of the non-woven fabric to corresponding products such as sanitary products. To this end, the non-woven web after the production thereof can be solidified in the forming section. This can be performed by way of a binding agent which is dispensed onto the dewatered non-woven web, or by hydraulic solidification, for example by water jets. A (final) solidification in the context of the present invention can also be a combination of (also multi-stage) water jet solidification, thus an hydraulic solidification method, and an additional soaking by a binding agent, thus a chemical solidification method. Drying of the non-woven web can be performed subsequently to the solidification of the non-woven web, for example by impregnating the latter by the binding agent which has been applied to said non-woven web in a bonding section. Optionally, subsequent mechanical solidification, for example by a needling machine, can further increase the strength of the non-woven web.

Agents which achieve mutual adhesive bonding of the fibers are considered binding agents, such that a fixed composite between the fibers results, for example. The term binding agents includes chemical binding agents which are dispensed in liquid form onto the non-woven web or are admixed to the fibrous suspension, for example. The binding agents connect the fibers to one another in a materially integral manner by way of adhesion.

The term water jet solidification or water jet needling relates to a hydraulic solidification method for producing a fixed composite between the fibers of a non-woven. Interlooping of the fibers and thus the compacting and solidification of the non-woven by entanglement results herein, for example in that focused high-pressure water jets act on the non-woven web.

For example, when the hydraulic solidification of the non-woven web is performed on the forming screen and thereon is preferably finally performed, the overall length of the device for producing a non-woven web in the running direction of the non-woven web to be produced can thus be significantly reduced. However, it would also be conceivable for the hydraulic solidification to be configured in multiple stages. A pre-solidification by water jet solidification could thus be performed initially on the forming screen, and the subsequent solidification could take place in a further process step outside the forming screen.

In order for the solidified non-woven web to be dried in a rapid and effective manner, the non-woven web can be dewatered mechanically, for example by means of a press, by means of a vacuum suction unit, or thermally by means of a dryer (for example by means of through-air drying technology, in this instance referred to as a through-air dryer).

Fibrous structures which are produced by crossing or looping yarns, such as takes place in weaving, warp or weft knitting, knitting, the production of lace, braiding, and the production of tufted products are not non-woven fabrics in the context of the invention. Films and paper are also not non-woven fabrics. Non-wovens according to the invention can preferably be produced from glass fibers, metal fibers, mineral fibers, ceramic fibers, or carbon fibers. These are also referred to as technical non-wovens. Fibers of this type can be glass fibers or else plastics material fibers such as aramid fibers, or else mineral fibers such as a basalt fibers. For example, steel fibers, stainless steel fibers, or titanium fibers are considered in the case of metallic fibers. The materials mentioned often have an elasticity modulus of at least 10 GPa. The materials in this instance are comparatively hard, brittle, and flexurally rigid, and cannot readily interloop and entangle with one another. It is therefore particularly advantageous when binding fibers which are less flexurally rigid are used in addition to the fibers.

A former such as an inclined screen former in the context of the invention is assigned a forming screen which at least along a distance, for example along a first distance portion, runs at an angle in relation to the horizontal. At least one headbox in this distance portion is in this instance disposed in such a manner that the headbox applies the fibrous suspension onto the forming screen on the upper side. Upper side means that the fibrous suspension is applied to the upper side of the forming screen. This is that side which faces away from the rollers on which the forming screen revolves, on the one hand, and on the other side faces towards the outlet of the headbox. At least one dewatering element for dewatering the just-applied fibrous suspension can be disposed on the lower side, thus in the region of the lower side of the forming screen. The dewatering element mentioned herein can be the device according to the invention. The headbox can in turn be assigned to the inclined screen former. The inclined screen former is typically disposed in such a manner that the first distance portion ascends at an angle in relation to a horizontal plane when viewed in the direction of the deposited non-woven web.

The forming screen and/or the carrier screen are typically embodied as endless inherently closed loops that revolve on rollers, for example. The forming screen and/or carrier screen can be specified in such a manner that the non-woven web can be water jet needled on the forming screen and/or carrier screen. This means that the corresponding forming screen and/or carrier screen is permeable to water such that the water jets can pass through the forming screen and/or carrier screen.

The decomposition temperature is understood to be the temperature at which the material of the fibers decomposes chemically or thermally, respectively. For example, the decomposition temperature is characteristic for materials which do not melt such as, for example, thermosetting plastics. The melting temperature is understood to be that temperature at which the material, for example of the fibers, transitions from the solid-state to the melt.

Besides the device for dewatering a wet-laid non-woven web from a fibrous suspension, the present invention also relates to the use of the device for producing a non-woven fabric which contains industrially made long fibers and preferably inorganic fibers or fibers from synthetically made polymers, the fibers of the non-woven fabric preferably having a decomposition or melting temperature of at least 300° C. An example of such fibers are glass fibers. Long fibers means fibers having a length from 6 to 38 mm. The invention is in principle suitable for all fiber lengths thus not only for long fibers.

The present invention furthermore relates to a machine for producing a wet-laid non-woven web, containing a former such as an inclined screen former; a forming screen assigned to the former for producing the non-woven fibrous web by depositing the fibers of the fibrous suspension onto the forming screen; having the device according to the invention for dewatering which is preferably disposed below the forming screen.

The present invention also relates to the product produced directly by the method according to the invention, thus to the non-woven fabric per se.

Other features which are considered as characteristic for the invention are set forth in the appended claims.

Although the invention is illustrated and described herein as embodied in a device for dewatering a wet-laid fibrous web, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
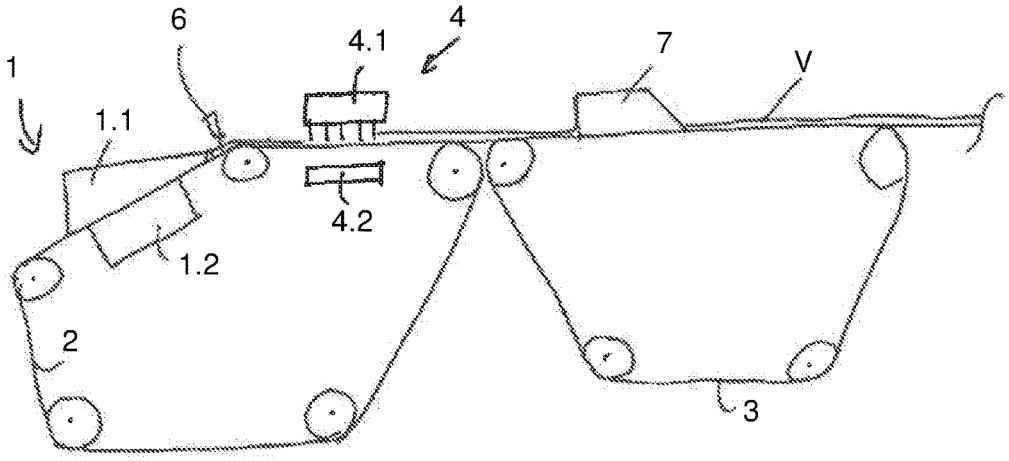
FIG. 1 is a diagrammatic, lateral view of a device according to the invention, according to one potential embodiment.

Referring now to the figures of the drawings in detail and first, particularly to FIG. 1 thereof, there is shown a part of a machine according to the invention for producing a wet-laid non-woven web and is shown schematically and thus not to scale in a lateral view. The device contains a former, presently embodied as an inclined screen former 1. The latter is assigned a continuous forming screen 2 which here revolves on rollers. The forming screen 2 revolves relative to the stationary inclined screen former 1. A headbox 1.1 is disposed above the forming screen 2. The latter is assigned to the inclined screen former 1. A fibrous suspension which by way of an outlet of the headbox 1.1 is capable of being applied onto the forming screen 2, more specifically onto the upper side of the latter, can be supplied to the headbox 1.1. The fibrous suspension typically contains a fibrous suspension such as a water/fiber mixture. The forming screen 2 is embodied such that the forming screen 2 allows the water to pass. The device 1.2 according to the invention, also referred to as a dewatering box, for discharging the liquid (here the water) from the fibrous suspension is disposed below the forming screen 2, on that side that faces the headbox 1.1. The device for dewatering 1.2 is assigned to the inclined screen former 1 of the machine.

The fibrous suspension in the intended operation of the machine by way of the outlet of the headbox 1.1 makes its way onto the forming screen 2 which by way of the rollers moves relative to the headbox 1.1 or the device for dewatering 1.2, respectively. The water flows through the forming screen 2 into the device for dewatering 1.2. The fibers from the fibrous suspension herein catch on the forming screen 2 and are transported onward with the latter. A corresponding non-woven web F is continuously deposited or formed, respectively, in this way on the forming screen 2.

The forming screen 2, when viewed in the running direction thereof, or in the running direction of the non-woven web V, in a first distance portion is inclined upward in relation to the horizontal. The inclined screen former 1 is disposed in this first distance portion, that is to say the non-woven web V is formed on this portion. The first distance portion herein is delimited by the upper rollers which are directly successive in the running direction of a carrier screen 3. To this end, at least two such upper rollers are provided. The forming screen 2 that in the illustration shown presently revolves in the clockwise direction thus ascends from the bottom left to the top right in the first distance portion.

The non-woven web V in the case illustrated, upon the formation thereof, for the hydraulic solidification thereof on the forming screen 2 is now guided below the solidification installation 4. The latter is assigned a multiplicity of water jet nozzles 4.1 which here lie above the forming screen 2, and an outlet 4.2 for water, the outlet 4.2 lying below the forming screen 2. As is illustrated, the forming screen 2 herein, in the region in which the water jet nozzles 4.1 and the outlet 4.2 are disposed, runs horizontally, or at least in portions substantially parallel to the horizontal plane, respectively. According to this embodiment, the non-woven web V is finally solidified on the forming screen 2.

The former thus forms the forming section of the machine. A bonding section of the machine in the running direction of the non-woven web V to be produced presently directly adjoins the forming section. The bonding section contains an application device 7 which is disposed above a carrier screen 3 that runs horizontally, or at least in portions substantially parallel to the horizontal plane, respectively. The finally hydraulically solidified non-woven web V can now be soaked with a chemical binding agent by the application device 7. A, for example, thermal dryer installation for drying the non-woven web V that is provided by a binder in the running direction of the non-woven web V to be produced (from left to right in the view of FIG. 1) can directly adjoin the bonding section (not shown).

A pre-solidification installation 6 in the running direction of the non-woven web to be produced can be disposed upstream of the hydraulic solidification installation 4. In principle, the pre-solidification installation 6 can be specified in a manner analogous to that of the hydraulic solidification installation 4, but be operated at a lower pressure than the solidification installation 4, the pressure being only 5 to 25 bar, for example. By contrast, the respective solidification installation 4 can be operated at a pressure of 15 to 400 bar. The solidification by means of the solidification installation 4 does not mandatorily have to take place on the forming screen 2, as is illustrated in FIG. 1. The solidification can also take place on a further section of the machine, for example on the carrier screen 3, that adjoins the former in the running direction of the non-woven web V.

Figure 2:
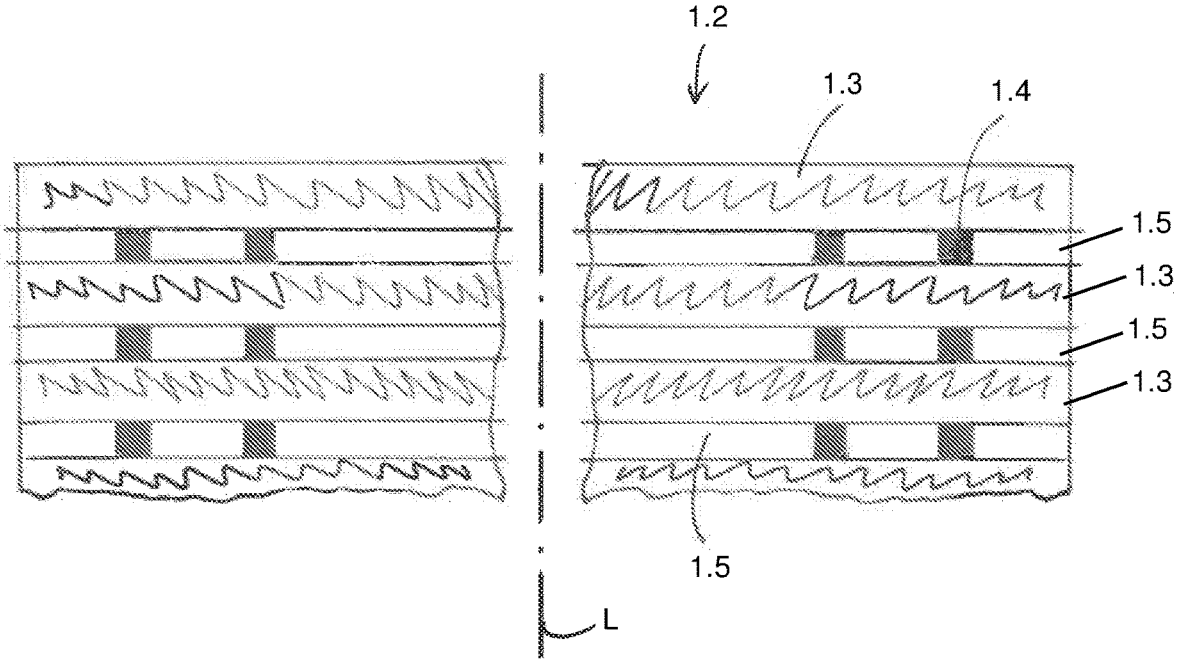
FIG. 2 is a highly schematic partially sectional plan view of the device according to the invention for dewatering, according to a first embodiment.
Figure 3:
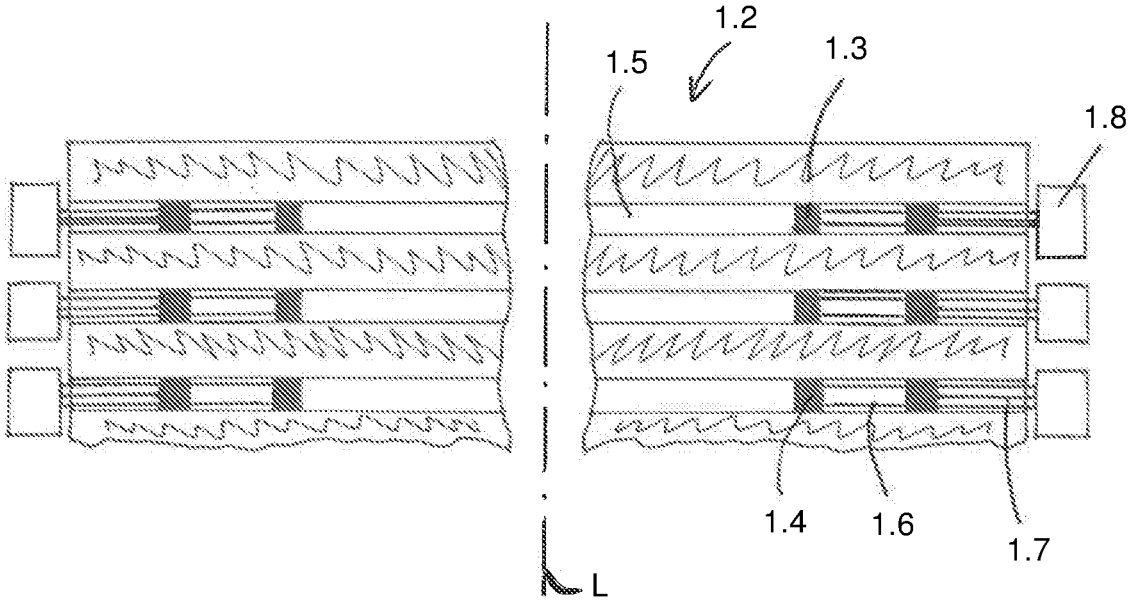
FIG. 3 is a highly schematic partially sectional plan view of the device according to the invention for dewatering, according to a second embodiment.

FIGS. 2 and 3 show in each case an embodiment of the invention in a partially sectional not to scale plan view of the device for dewatering 1.2, the section being in the direction in which the liquid of the fibrous suspension flows from the headbox 1.1 (FIG. 1). The longitudinal axis or symmetry axis L, respectively, illustrated, at the same time corresponds to the running direction of the machine, thus the direction in which the non-woven web from FIG. 1 is transported within the machine.

According to these two embodiments, the device for dewatering 1.2, thus the dewatering box, contains a multiplicity of dewatering strips 1.3 which are disposed at a mutual spacing. The dewatering strips 1.3 are longer than they are wide. The longitudinal extent of the dewatering strips 1.3 in the illustration of FIGS. 2 and 3 thus runs so as to be orthogonal to the longitudinal axis or symmetry axis L, respectively.

Two directly neighboring dewatering strips 1.3 conjointly configure one dewatering gap 1.5. The latter serves for discharging by way of the device 1.2 the liquid from the fibrous suspension which passes through the forming screen 2 (FIG. 1). To this end, the dewatering gaps 1.5 can be connected to a discharge line (not shown) in order for the liquid to be discharged.

As is illustrated in FIGS. 2 and 3, each dewatering gap 1.5 shown is assigned exactly four format slides 1.4. The latter are intended to locally obscure the dewatering gap 1.5. The format slides 1.4 can be disposed such that they reach into the dewatering gap 1.5. The intended purpose of the format slides 1.4 is specifically to locally prevent any dewatering by way of the device 1.2. No fibers are deposited on top of the forming screen 2 (FIG. 1) in these four regions of the respective dewatering gap 1.5, that are "masked" by the format slides 1.4, that is to say that no non-woven web V is locally generated. To this end, the longitudinal extent of the format slides 1.4 is only a fraction of the longitudinal extent of the respective dewatering gap 1.5.

The format slides 1.4 can be embodied such that the format slides 1.4 are capable of being releasably connected to the device 1.2, for example to the dewatering strips 1.3. This means that the format slides 1.4 are capable of being captively fixed to the device 1.2 by way of a form-fit and/or force-fit, for example and are capable of being clamped to the at least one of the two neighboring dewatering strips 1.3, for example. However, this connection is also releasable. A variable mutual adjustment of the format slides 1.4 can thus be achieved within the one dewatering gap 1.5. In other words, the mutual spacings of the format slides 1.4 within the one dewatering gap 1.5 can be adjusted in an arbitrary manner. This can be achieved, for example, by way of an axial displacement, also in a mutually independent manner, of the format slides 1.4 along the dewatering gap 1.5 assigned to the latter, specifically in a manner orthogonal to the longitudinal axis or symmetry axis L, respectively. On account thereof, the width of the non-woven web V to be produced can be set.

As is indicated in FIGS. 2 and 3, the respective format slides 1.4 of mutually neighboring dewatering gaps 1.5 can be set to the same mutual position. In other words, the spacings of mutually corresponding format slides 1.4 of mutually neighboring dewatering gaps 1.5 can be set so as to be equidistant such that rows of format slides 1.4 which run so as to be parallel to the longitudinal axis or symmetry axis L, respectively, result by way of the device for dewatering 1.2.

Should an even number of format slides 1.4 which are assigned to the same dewatering gap 1.5 be chosen, thus four, for example, one half of the number, thus two, when viewed in the longitudinal direction, is assigned to an axial end of the two neighboring dewatering strips 1.3 that form the dewatering gap 1.5, and the remaining half of the format slides 1.4 is assigned to the opposite axial end of the device for dewatering 1.2. The axial ends relate to a longitudinal axis which in FIGS. 2 and 3 corresponds to the longitudinal extent of the dewatering strips 1.3, thus to an orthogonal in relation to the longitudinal axis and symmetry axis L. It could also be said that the mutually opposite axial ends of the dewatering strips 1.3 of the device for dewatering 1.2 correspond to the drive side and to the operator side of the machine according to the invention.

A potential for individually setting the mutual spacings of the format slides 1.4 is illustrated in the embodiment of FIG. 3. To this end, all slides of a corresponding dewatering gap 1.5 have a slide mechanism by which the slides are mounted so as to be, preferably in a stepless manner, axially displaceable along the dewatering gap 1.5. In the case of this slide mechanism, the outer format slide that is in each case more proximal to the axial end of the dewatering strip is assigned one pushrod 1.7. The inner format slide that is more distal from the axial end of the dewatering strip, by means of a sleeve 1.6 that surrounds the pushrod 1.7 is guided so as to be axially displaceable relative to the device in the longitudinal direction of the dewatering gap. The inner format slide can thus be repositioned by axially displacing the sleeve, and the outer format slide can be repositioned by axially displacing the pushrod.

The respective pushrod 1.7 and the sleeve 1.6 which are assigned to each individual dewatering element that is embodied so as to be axially displaceable, for the axial adjustment of the pushrod 1.7 and the sleeve 1.6, can be driven by hand or by way of a drive 1.8 such as a linear drive. The individual format slides 1.4 by means of the slide mechanism according to the invention can be selectively adjusted in an arbitrary manner, also in a stepless manner, and particularly preferably even during the operation of the machine for producing the wet-laid non-woven web. Edge trimmers and additional resources required therefor, such as compressed air or spray water, can be dispensed with on account of the use of the format slides 1.4. On account of the use of the device, a plurality of non-woven webs can also be produced beside one another and simultaneously on the same forming screen. The finished non-woven fabric moreover has a particularly uniform transverse profile in terms of area weight.

The invention claimed is:

1. A device for dewatering a wet-laid non-woven web formed from a fibrous suspension, the device comprising:

a plurality of dewatering strips disposed so as to be mutually spaced apart, wherein mutually neighboring said dewatering strips conjointly delimit a dewatering gap for discharging a liquid from the fibrous suspensions; and at least three format slides which along a longitudinal direction of said dewatering gap are disposed or disposable so as to be distributed relative to one another and which partially obscure said dewatering gap in such a manner that any discharging of the liquid by way of an obscured part of said dewatering gap is prevented.

2. The device according to claim 1, wherein said format slides at least partially reach into said dewatering gap of two directly neighboring said dewatering strips.

3. The device according to claim 1, wherein said format slides along said dewatering gap are positionable in a mutually relative manner and are axially displaceable in the longitudinal direction.

4. The device according to claim 1, wherein said format slides disposed in said dewatering gap and said format slides disposed in another said dewatering gap of the device and within a same said dewatering gap are positionable in a mutually independent and mutually relative manner and are axially displaceable in the longitudinal direction.

5. The device according to claim 1, wherein said format slides that are assigned to a same said dewatering gap are capable of being releasably connected to the device so as to set a width of the wet-laid non-woven web to be produced in dependence on an axial mutual spacing, when viewed in the longitudinal direction of said dewatering gap.

6. The device according to claim 1, wherein at least four said format slides are assigned to said dewatering gap, wherein two of said format slides, when viewed in the longitudinal direction, are in each case assigned to a first axial end of said two neighboring dewatering strips that form said dewatering gap, and a remaining two said format slides are assigned to an opposite, second axial end.

7. The device according to claim 6, further comprising a slide mechanism; and wherein said format slides in a region of said first and second axial ends are mounted on the device so as to be axially displaceable by way of said slide mechanism.

8. The device according to claim 7, further comprising a push rod;

further comprising a sleeve surrounding said push rod; and wherein an outer format slide of said format slides which in each case is more proximal to said first axial end of said dewatering strip, by means of said push rod, and an inner format slide of said format slides which is more distal from said opposite, second axial end of said dewatering strip, by means of said sleeve, are embodied so as to be axially displaceable, relative to the device, in the longitudinal direction of said dewatering gap.

9. The device according to claim 1, further comprising a drive and, when viewed in the longitudinal direction, said drive is provided for setting a spacing of said format slides mutually or relative to an axial end of a respective said dewatering strip.

10. The device according to claim 1, wherein said format slides are supported on at least one of two neighboring said dewatering strips which define said dewatering gap.

11. The device according to claim 1, wherein said format slides in said dewatering gap, conjointly with two neighboring said dewatering strips which define said dewatering gap, are sealed in relation to a passage of the liquid into a non-covered part of said dewatering gap.

12. The device according to claim 1, wherein the device is free of an edge trimmer for cutting an edge of the wet-laid non-woven web to be dewatered.

13. The device according to claim 3, wherein said format slides along said dewatering gap are axially displaceable in the longitudinal direction, in a mutually independent manner of each other.

14. The device according to claim 6, wherein said device has exactly four said format slides assigned to said dewatering gap.

15. The device according to claim 7, wherein said format slides are mounted on the device so as to be axially displaceable, in a stepless manner, by way of said slide mechanism.

16. The device according to claim 9, wherein said drive is a linear drive.

17. A machine for producing a wet-laid non-woven web, comprising a former such as an inclined screen former;

a forming screen assigned to said former, for producing the wet-laid non-woven web by depositing fibers of a fibrous suspension onto the forming screen; and a device for dewatering the wet-laid non-woven web of the fibrous suspension, said device having a plurality of dewatering strips disposed so as to be mutually spaced apart, wherein mutually neighboring said dewatering strips conjointly delimit a dewatering gap for discharging a liquid from the fibrous suspensions, said device further having at least three format slides which along a longitudinal direction of a respective said dewatering gap are disposed or disposable so as to be distributed relative to one another and which partially obscure said respective dewatering gap in such a manner that any discharging of the liquid by way of an obscured part of the dewatering gap is prevented.

* * * * *